US009824664B2

(12) United States Patent
Fukuda

(10) Patent No.: US 9,824,664 B2
(45) Date of Patent: Nov. 21, 2017

(54) CALIBRATION DEVICE, CALIBRATION METHOD AND DISPLAY DEVICE

(71) Applicant: CANON KABUSHIKI KAISHA, Tokyo (JP)

(72) Inventor: Tetsu Fukuda, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 110 days.

(21) Appl. No.: 14/628,594

(22) Filed: Feb. 23, 2015

(65) Prior Publication Data

US 2015/0243250 A1 Aug. 27, 2015

(30) Foreign Application Priority Data

Feb. 25, 2014 (JP) ..... 2014-034234

(51) Int. Cl.

| | |
|---|---|
| ***G09G 5/02*** | (2006.01) |
| ***G09G 3/00*** | (2006.01) |
| *G09G 5/36* | (2006.01) |
| *G09G 3/34* | (2006.01) |
| *G09G 5/00* | (2006.01) |

(52) U.S. Cl.

CPC ..... *G09G 5/02* (2013.01); *G09G 3/006* (2013.01); *G09G 3/3406* (2013.01); *G09G 5/003* (2013.01); *G09G 5/36* (2013.01); *G09G 2320/0626* (2013.01); *G09G 2320/0666* (2013.01); *G09G 2320/0673* (2013.01); *G09G 2320/0693* (2013.01); *G09G 2320/08* (2013.01); *G09G 2360/145* (2013.01); *G09G 2370/04* (2013.01)

(58) Field of Classification Search

None

See application file for complete search history.

(56) References Cited

U.S. PATENT DOCUMENTS

2010/0188418 A1* 7/2010 Sakai ..... G01J 1/4204 345/594

FOREIGN PATENT DOCUMENTS

| | | |
|---|---|---|
| JP | 09-224161 A | 8/1997 |
| JP | 2003-227778 A | 8/2003 |

OTHER PUBLICATIONS

Leonard Rapoport ("Calibrating Your Monitor With Datacolor's Spyder4 Pro With Len Rapoport IMPress Magazine," https://www.youtube.com/watch?v=88jxtM4HAKE, Feb. 8, 2013.*

(Continued)

*Primary Examiner* — Nicholas R Wilson

(74) *Attorney, Agent, or Firm* — Cowan, Liebowitz & Latman, P.C.

(57) ABSTRACT

A calibration device for a display device having a plurality of image quality adjustment items, the calibration device comprises a storage unit that stores set values of a plurality of parameters which are used respectively in processing of the plurality of image quality adjustment items, a calibration unit that implements calibration to update the set values of the plurality of parameters, by implementing, a plurality of times, processing for displaying a colorimetry image on the display device and determining the value of any of the parameters, using colorimetry results from the colorimetry image, and a display unit that displays, on the display device, a confirmation image for confirming the effects of calibration. The display unit displays the confirmation image at the image quality settings during calibration.

25 Claims, 10 Drawing Sheets

| | | | | | | |
|---|---|---|---|---|---|---|
| FIRST IMAGE PROCESSING UNIT | | | | | | |
| BACKLIGHT BRIGHTNESS | OFF | ON | ON | ON | ON | ON |
| COLOR TEMPERATURE | OFF | OFF | ON | ON | ON | ON |
| COLOR GAMUT | OFF | OFF | OFF | ON | ON | ON |
| γ VALUE | OFF | OFF | OFF | OFF | OFF | ON |
| SECOND IMAGE PROCESSING UNIT | | | | | | |
| BACKLIGHT BRIGHTNESS | (ON) | (ON) | ON | ON | ON | ON |
| COLOR TEMPERATURE | (ON) | (ON) | ON | ON | ON | ON |
| COLOR GAMUT | (ON) | (ON) | (ON) | (ON) | ON | ON |
| γ VALUE | (ON) | (ON) | (ON) | (ON) | (ON) | ON |

(ON) : IMAGE CORRECTION PARAMETER BEFORE CALIBRATION
ON : IMAGE CORRECTION PARAMETER AFTER CALIBRATION

(56) References Cited

OTHER PUBLICATIONS

Brenda K. Hipsher, "X-Rite i1Display Pro Advanced Features | Uniformity Check Guest Blog by Cloratti Dennis Dunbar," Aug. 16, 2011, http://blog.xritephoto.com/2011/08/x-rite-i1display-pro-advanced-features-uniformity-check-guest-blog-by-coloratti-dennis-dunbar/#sthash.ZdPpJcNj.dpbs.*

* cited by examiner

FIG. 7A

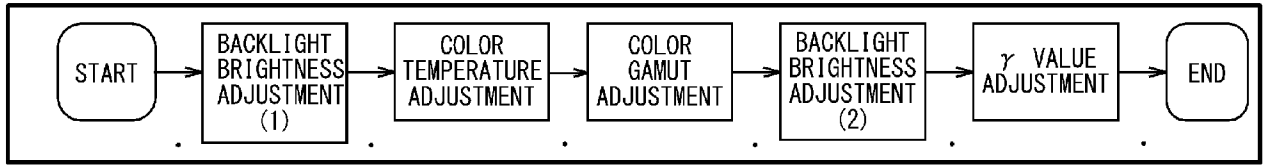

FIG. 7B

| | | | | | | |
|---|---|---|---|---|---|---|
| FIRST IMAGE PROCESSING UNIT | | | | | | |
| BACKLIGHT BRIGHTNESS | OFF | ON | ON | ON | ON | ON |
| COLOR TEMPERATURE | OFF | OFF | ON | ON | ON | ON |
| COLOR GAMUT | OFF | OFF | OFF | ON | ON | ON |
| γ VALUE | OFF | OFF | OFF | OFF | OFF | ON |
| SECOND IMAGE PROCESSING UNIT | | | | | | |
| BACKLIGHT BRIGHTNESS | (ON) | (ON) | ON | ON | ON | ON |
| COLOR TEMPERATURE | (ON) | (ON) | ON | ON | ON | ON |
| COLOR GAMUT | (ON) | (ON) | (ON) | (ON) | ON | ON |
| γ VALUE | (ON) | (ON) | (ON) | (ON) | (ON) | ON |

(ON) : IMAGE CORRECTION PARAMETER BEFORE CALIBRATION
ON : IMAGE CORRECTION PARAMETER AFTER CALIBRATION

CALIBRATION DEVICE, CALIBRATION METHOD AND DISPLAY DEVICE

BACKGROUND OF THE INVENTION

Field of the Invention

The present invention relates to a calibration device, a calibration method and a display device.

Description of the Related Art

In recent years, there has been an increase in the importance of color management for standardizing output colors by carrying out color adjustment between devices which handle images, such as monitors, digital cameras, printers, and the like. Color management achieves accurate color reproduction in respect of the outputs of respective devices, by exchanging image data via a color reproduction range which is independent of the respective devices, such as monitors, printers, and the like. In particular, it is necessary to reproduce colors stably with extremely high accuracy, in respect of the colors output from a monitor which is used for tasks of handling accurate colors, such as editing still images or checking printed matter, or the like. Therefore, accurately carrying out calibration periodically in order to maintain uniform reproducibility of the colors output on a monitor is an especially important point in color management.

One example of the prior art relating to calibration of this kind includes the technology described in Japanese Patent Application Publication No. H09-224161. In the technology described in Japanese Patent Application Publication No. H09-224161, when calibrating a color device, a plurality of calibration setting methods having different color reproduction accuracies and different calculation times are stored, and one of the stored calibration setting methods is selected and instructed for use. Moreover, in the technology described in Japanese Patent Application Publication No. H09-224161, calculation means for executing calibration calculations on the basis of the selected and instructed calibration setting method is also provided.

Furthermore, there is also technology according to which, when calibration of a monitor is carried out, measurement object points are displayed on a region which is a previously set measurement object, or a measurement object frame is displayed on a region which is an arbitrarily specified measurement object. Alternatively, there is technology according to which, when calibrating a monitor, the whole of the monitor is displayed by being divided into a plurality of partial regions, whereupon measurement object points, a measurement object frame, or the like, are displayed in the region to be the measurement object so that this region can be distinguished from the other regions. Moreover, there is technology according to which, after providing a display of this kind, calibration is carried out on the basis of brightness data measured by aligning a brightness meter with the measurement object point (frame) (for example, Japanese Patent Application Publication No. 2003-227778).

In the calibration according to the prior art described above, after an adjustment target value has been set by the user, patch display, colorimetry, correction calculation, and various look up table (LUT) settings, and the like, are repeated until calibration is completed.

In the prior art technology described above, the images which can be viewed by the user during the calibration process are, basically, a patch display or a display guide of the brightness meter location position disclosed in Japanese Patent Application Publication No. 2003-227778, and the like.

Conventionally, after completing all of the calibration tasks, the image that the user was operating on before calibration or a reference image is displayed, and the user simply confirms the display on the monitor after calibration. Therefore, the improvement made by calibration is difficult for the user to perceive, and the user may not feel a sense of agreement with the calibration that has been made.

Normally, with the monitor before calibration, an image quality adjustment process is switched on based on adjustment values (set values) before calibration, and an image is displayed. In order to carry out the calibration process, it is necessary to switch off the image quality adjustment process based on the adjustment values before calibration, temporarily, during calibration. When a reference image is displayed during calibration, then a reference image in which the image quality adjustment process has been switched off is temporarily visible to the user. Furthermore, after calibration, the image quality adjustment process is switched on and the reference image which has been adjusted on the basis of the set values after calibration becomes visible to the user. Therefore, the user sees a non-adjusted reference image in which the image quality adjustment process has been switched off, and then sees a reference image which has been adjusted by the set values after calibration. Consequently, it is difficult for the user to ascertain whether or not image quality has been improved by the calibration.

SUMMARY OF THE INVENTION

It is an object of the present invention to provide a calibration device whereby the process of improvement of image quality due to calibration can be confirmed.

A first aspect of the present invention resides in a calibration device for a display device having a plurality of image quality adjustment items, the calibration device comprising: a storage unit configured to store set values of a plurality of parameters which are used respectively in processing of the plurality of image quality adjustment items; a calibration unit configured to implement calibration to update the set values of the plurality of parameters, by implementing, a plurality of times, processing for displaying a colorimetry image on the display device and determining the value of any of the parameters, using colorimetry results from the colorimetry image; and a display unit configured to display, on the display device, a confirmation image for confirming the effects of calibration, wherein the display unit displays the confirmation image at the image quality settings during calibration.

A second aspect of the present invention resides in a calibration method for a display device having a plurality of image quality adjustment items, a storage unit being provided for storing set values of a plurality of parameters which are used respectively in processing of the plurality of image quality adjustment items, the method comprising: implementing calibration to update the set values of the plurality of parameters, by implementing, a plurality of times, processing for displaying a colorimetry image on the display device and determining the value of any of the parameters, using colorimetry results from the colorimetry image; and displaying a confirmation image for confirming the effects of calibration on the display device at an image quality setting during calibration.

A third aspect of the present invention resides in a display device, which is provided with the calibration device.

According to the present invention, it is possible to provide a calibration device whereby the process of improvement of image quality due to calibration can be confirmed.

Further features of the present invention will become apparent from the following description of exemplary embodiments with reference to the attached drawings.

BRIEF DESCRIPTION OF THE DRAWINGS

FIG. 7A is a diagram showing an example of a calibration flow and FIG. 7B is a diagram showing a state of image quality adjustment parameters;

DESCRIPTION OF THE EMBODIMENTS

Below, an embodiment for implementing the present invention will be described with reference to the drawings and the flowcharts. The present invention is not limited to the embodiments described below.

First Embodiment

Configuration Example

Figure 1:
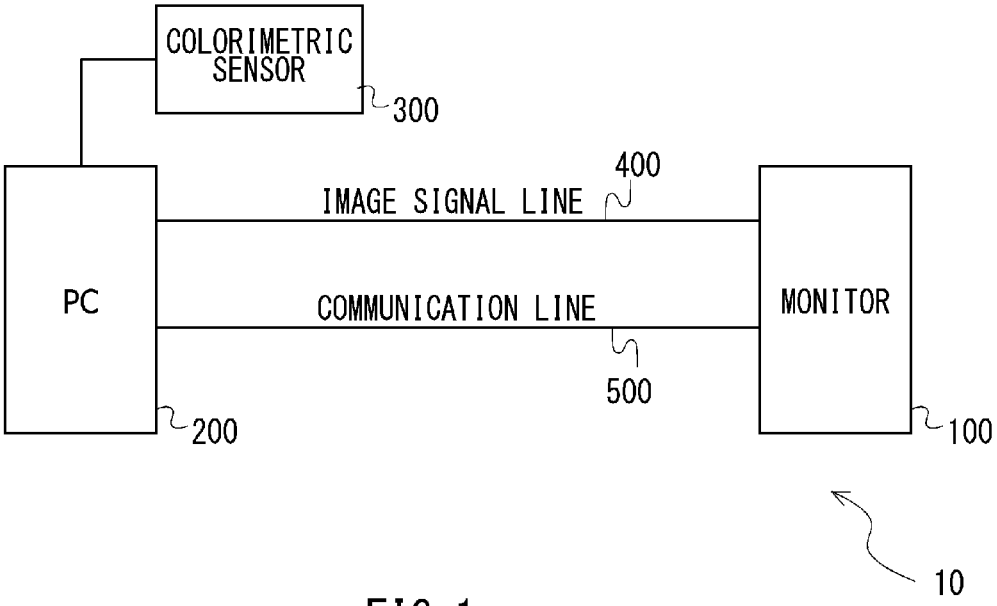
FIG. 1 is a diagram showing an Example (1) of the general configuration of a calibration control system.

FIG. 1 is a diagram showing an Example (1) of the general configuration of a calibration control system according to the present embodiment. The calibration control system 10 carries out calibration of a monitor. In the example in FIG. 1, the calibration control system 10 which is an overall configuration according to the present embodiment includes a monitor 100 and a personal computer (PC) 200. Furthermore, a colorimetric sensor 300 is connected to the PC 200.

Figure 2:
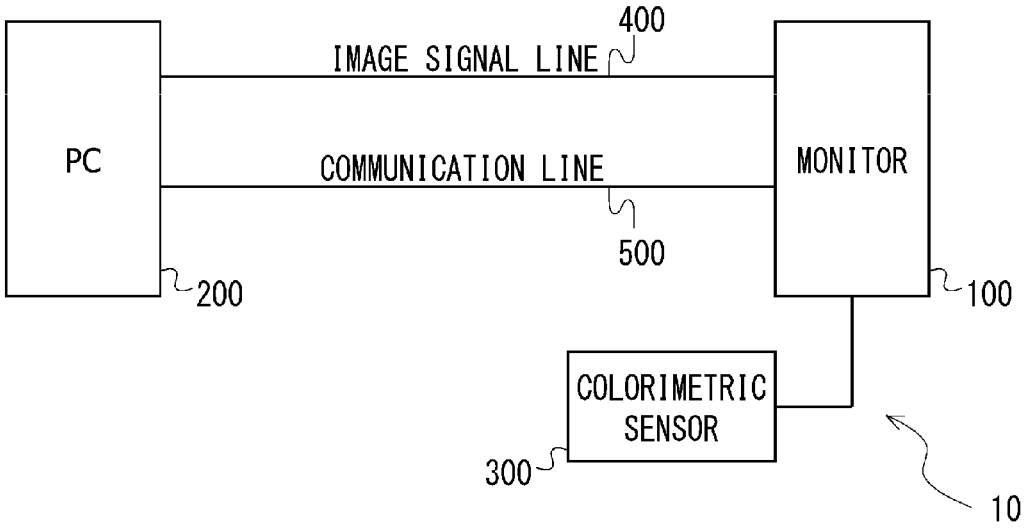
FIG. 2 is a diagram showing an Example (2) of the general configuration of a calibration control system.

FIG. 2 is a diagram showing an Example (2) of the general configuration of the calibration of a monitor according to the present embodiment. In the example in FIG. 2, the calibration control system 10 which is the overall configuration according to the present embodiment includes a monitor 100 and a PC 200. Furthermore, a colorimetric sensor 300 is connected to the monitor 100.

The PC 200 and the monitor 100 are connected by an image signal line 400 and a communication line 500. The image signal line 400 and the communication line 500 may be integrated.

The PC 200 outputs an image signal to a monitor 100 and runs an application which carries out a calibration calculation process. The monitor 100 is a monitor which is the object of display image quality adjustment. The colorimetric sensor 300 measures the display colors of the image (colorimetry image) displayed on the monitor 100. The image signal line 400 transfers an image signal transmitted to the monitor 100, from the PC 200. The communication line 500 transfers data which is communicated between the PC 200 and the monitor 100.

Figure 3:
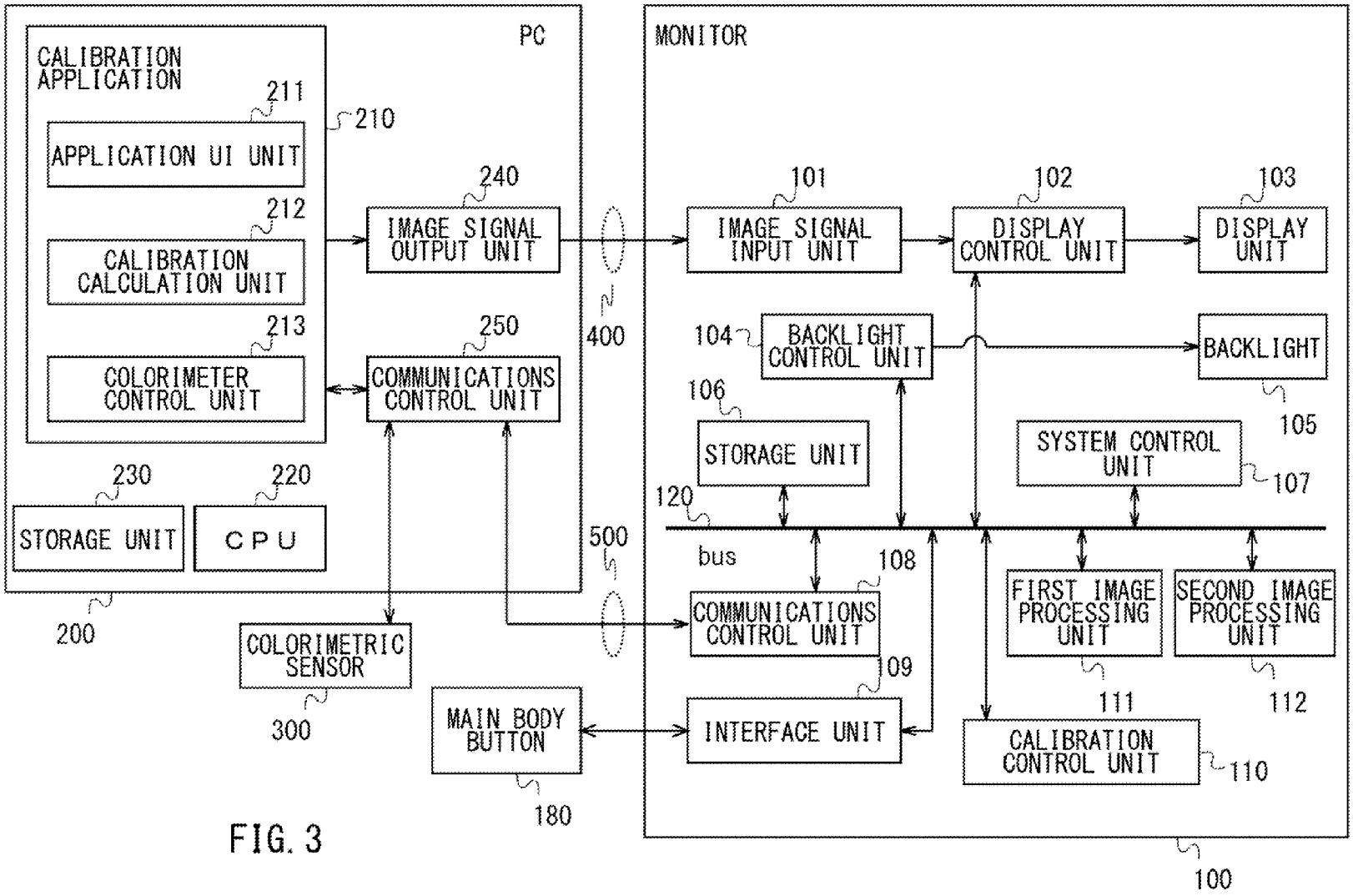
FIG. 3 is a diagram showing an example of the configuration of a calibration control system.

FIG. 3 is a diagram showing an example of the configuration of a calibration control system. The monitor 100 and the PC 200 of the calibration control system 10 achieve calibration of the monitor 100 by coordinated operation. The monitor 100 and the PC 200 of the calibration control system 10 may be integrated with each other to operate as a calibration device. Furthermore, one portion of the monitor 100 and one portion of the PC 200 may be integrated with each other to operate as a calibration device. Here, the colorimetric sensor 300 is connected to the PC 200. The monitor 100 and the PC 200 are connected by an image signal line 400 and a communication line 500. The connection between the monitor 100 and the PC 200 may be a wired connection or may be a wireless connection. The monitor 100 is provided with a main body button 180. The monitor 100 is operated by operation of the main body button by the user. Furthermore, the monitor 100 may be connected to a remote control unit (not illustrated) and may be operated by a remote control operation performed by the user.

The monitor 100 includes: an image signal input unit 101, a display control unit 102, a display unit 103, a backlight control unit 104, a backlight 105, a storage unit 106, a system control unit 107, a communications control unit 108 and an interface unit 109. Moreover, the monitor 100 includes a calibration control unit 110, a first image processing unit 111 and a second image processing unit 112. Furthermore, the monitor 100 includes a bus 120.

The monitor 100 displays an image based on an image signal input from the PC 200, on a screen of the display unit 103.

The PC 200 includes a calibration application 210, a CPU 220, a storage unit 230, an image signal output unit 240 and a communications control unit 250.

The PC 200 runs the calibration application 210. The calibration application 210 includes an application user interface (UI) unit 211, a calibration calculation unit 212 and a colorimeter control unit 213. The application UI unit 211 controls a graphical user interface (GUI) of the calibration application 210. The calibration calculation unit 212 carries out a calculation process for calibration. The colorimeter control unit 213 controls the colorimetric sensor 300.

The program for achieving the calibration application 210 is supplied to the PC 200 by a computer-readable portable medium, or via the Internet, and is installed in the PC 200. Alternatively, it is also possible to provide a storage device on which a program for the PC 200 to achieve the calibration application 210 is stored.

The image signal of the GUI image from the application UI unit 211 is output by the image signal output unit 240. Furthermore, the application UI unit 211 receives input of data, such as target values for adjustment items used for calibration, from the user, and stores and saves same to the storage unit 230. The application UI unit 211 acquires data used by the calibration application 210, from the storage unit 230.

The target value of the adjustment item is a target value of an adjustment item of display characteristics of the monitor 100. The adjustment items for which target values (calibration target values) are input may be, for example, the white color brightness (luminance), the black color brightness, the white color chromaticity, the contrast ratio, the γ value, and so on. These adjustment items are examples, and it is not necessary to include all of these adjustment items, and it is possible to include adjustment items apart from these.

The calibration calculation unit 212 implements a calibration calculation using the calibration target value input by the application UI unit 211 and a colorimetric value measured by the colorimeter control unit 213 (colorimetric result). By means of the calibration calculation, the parameters (image quality adjustment parameters) and various look up tables (LUTs), and the like, are calculated. The parameters and/or various LUTs, and the like, have correspondence relationships for determining the backlight and drive signal of the display panel, in accordance with the input image signal. The parameters and/or various LUTs, and the like, are stored in the storage unit 230. The calibration calculation unit 212 sends the various LUTs, and the like, which are the result of the calibration calculation, to the monitor 100, via the communications control unit 250 and the communication line 500.

The colorimeter control unit 213 implements a series of controls relating to colorimetry via the communications control unit 250, in the colorimetric sensor 300 which is connected to the PC 200, and acquires colorimetric values. The colorimetric values include, for example, information about the brightness and chromaticity. The colorimeter control unit 213 stores the acquired colorimetric values in the storage unit 230.

Furthermore, the calibration application 210 receives data that has been processed by the calibration control unit 110, and the like, of the monitor 100, and which is required for calibration, via the communication line 500 and the communications control unit 108. The calibration application 210 outputs an image signal, such as a GUI image to be displayed, to the image signal input unit 101 of the monitor 100, via the image signal output unit 240.

The CPU 220 controls the operation of the PC 200. The CPU 220 develops a program for achieving the calibration application 210, in the memory, and executes the program. Thereby, the calibration application 210 is operated.

The storage unit 230 stores programs which are implemented by the PC 200, and data which is used by the programs, and the like. Furthermore, the storage unit 230 stores colorimetric values which are measured by the colorimetric sensor 300.

The PC 200 starts up an application (not illustrated) for the user to display and edit images, apart from the calibration application 210 described above. Similarly to the image of the calibration application 210, the PC 200 outputs an image signal of the image of the application that is being started up (PC image) on the image signal input unit 101 of the monitor 100, via the image signal output unit 240.

The display control unit 102 carries out image processing on the image signal input to the image signal input unit 101, in the first image processing unit 111 or the second image processing unit 112, to generate display data, and outputs this display data to the display unit 103. Furthermore, the display control unit 102 generates display data produced through synthesizing the display data described above and the GUI image data, and outputs this display data to the display unit 103, when there is GUI image data that has been generated by a GUI generation unit (not illustrated).

The display unit 103 is constituted by a liquid crystal panel, and displays an image based on display data output from the display control unit 102. The monitor 100 is not limited to a liquid crystal display.

The backlight control unit 104 controls the light emission brightness of the backlight 105, on the basis of a brightness values (backlight brightness) set by the first image processing unit 111 and the second image processing unit 112. The backlight control unit 104, for example, determines drive current values, and the like, for each of the LEDs of the backlight 105, and drives the backlight 105 accordingly.

The backlight 105 is a module which illuminates the liquid crystal panel of the display unit 103. The backlight 105 is an example of a light-emitting unit. The light emitting unit of the present invention is not limited to a backlight for a liquid crystal display.

The backlight 105 includes a plurality of LEDs, and each LED emits light at a brightness corresponding to the determined drive current value, and the like, by control of the backlight control unit 104. Each of the LEDs respectively illuminates a prescribed region of the liquid crystal panel. The LEDs are white LEDs or RGB-LEDs. The RGB-LEDs includes LEDs of three colors: red, green and blue, and the lights of three colors emitted from the respective LEDs are mixed to form a white color.

The monitor 100 is provided with a local dimming function. The backlight control unit 104 can implement control to switch the light emission brightness of each respective LED of the backlight 105, by the local dimming function.

The storage unit 106 stores data, and the like, which is used by the monitor 100.

The system control unit 107 implements overall control of the functions achieved by the monitor 100.

The communications control unit 108 is connected to the PC 200 via the communication line 500 and sends and receives data to and from the PC 100.

The interface unit 109 receives a control signal for receiving an operation from the user, via a user interface, such as the remote controller or main body button 180, or the like. The interface unit 109 issues a request for generation or operation of a GUI, to the GUI generation unit, in accordance with a received control signal.

The GUI generation unit generates GUI image data on the basis of the control signal received by the interface unit 109. Here, the material data, and the like, required for GUI image data is acquired from the storage unit 106 located inside the monitor 100, and when the data is updated, is saved and stored similarly in the storage unit 106.

The calibration control unit 110 receives various image quality adjustment values for calibrating the monitor as calculated by the calibration calculation unit 212 in the calibration application 210, and implements control for adjusting the image quality of the monitor 100. Furthermore, the calibration control unit 110 carries out a process for displaying a colorimetry image (color patch) for colorimetry via the GUI generation unit, on the basis of a patch display request which has been received from the calibration application 210. The details of the calibration control are described hereinafter.

The first image processing unit 111 carries out image quality adjustment processing on the image displayed in the first region of the display unit 103, on the basis of the image quality adjustment parameters, and the image signal, and the like, which is input from the display control unit 102. The first image processing unit 111 outputs the image processed data to the display control unit 102. Furthermore, the first image processing unit 111 reports a backlight brightness value to the backlight control unit 104, on the basis of the image quality adjustment parameter.

Similarly to the first image processing unit 111, the second image processing unit 112 carries out image quality adjustment processing on the image displayed on the second region of the display unit 103.

The monitor 100 according to the present embodiment has a plurality of image processing systems in the first image processing unit 111 and the second image processing unit 112, and therefore it is possible to carry out image quality adjustment independently in each respective region of the display unit 103 (screen).

The colorimetric sensor 300 is a sensor which measures the brightness and chromaticity, and the like, of the image which is displayed in a prescribed region of the display unit 103 of the monitor 100. The prescribed region is a region where the colorimetry image for calibration processing is displayed. The colorimetric sensor 300 is disposed so as to be able to measure the color of the colorimetry image.

Operation Examples

Firstly, the operation of the calibration control of the PC 200 will be described.

Figure 4:
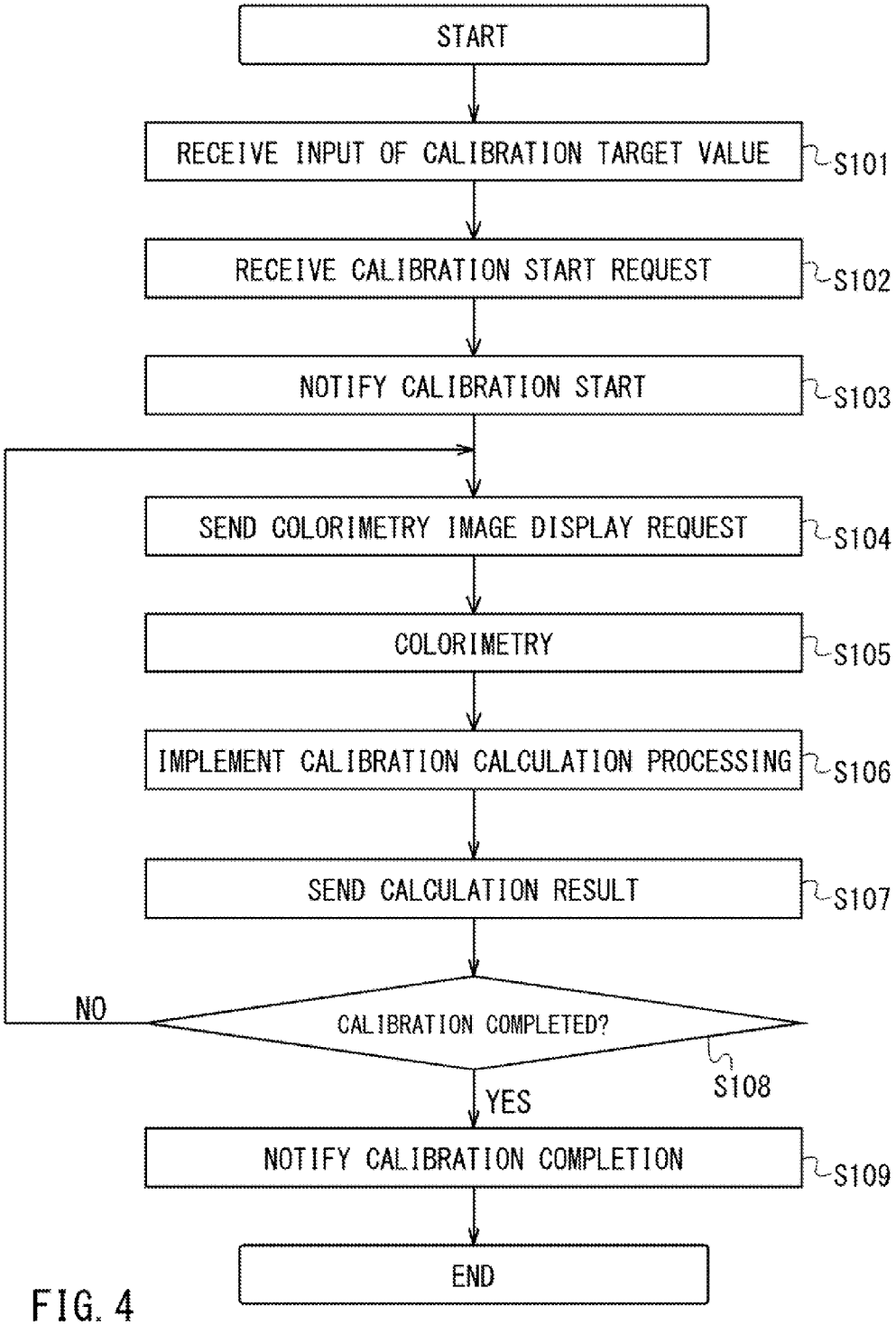
FIG. 4 is a diagram showing an example of a calibration control flow of the PC relating to a first embodiment.

FIG. 4 is a diagram showing an example of a calibration control flow of the PC 200 relating to a first embodiment.

In step S101, the calibration application 210 of the PC 200 receives the input of a calibration target value from a user via a mouse or keyboard, or the like, of the PC 200. When inputting a target value, for example, the target value is input by the user selecting one target value from a plurality of target values. Furthermore, the calibration application 210 initializes the colorimetric sensor 300. In this case, the user disposes the colorimetric sensor 300 on the monitor 100. The calibration application 210 may prompt the user to dispose the colorimetric sensor 300 on the monitor 100 by displaying a message. Moreover, the calibration application 210 may notify the user that the disposition of the colorimetric sensor 300 on the monitor 100 has been completed.

In step S102, the calibration application 210 receives a calibration start request from the user.

In step S103, the calibration application 210 sends a calibration start notification to the monitor 100 via the communications control unit 250 and the communication line 500. Here, depending on the status (state) of the monitor 100, there may be cases where a notification is received from the monitor 100 indicating that the implementation of calibration is not possible. In this case, the calibration application 210 notifies the user that the calibration cannot be implemented, and calibration is terminated.

On the other hand, when the monitor 100 is able to implement calibration, the monitor 100 sends a calibration transfer completion notification to the PC 200. When the PC 200 has received a calibration transfer completion notification from the monitor 100, the calibration application 210 carries out calibration in accordance with the logic of the calibration calculation unit 212.

From step S104 onwards, a plurality of adjustment steps, such as brightness adjustment of the backlight 105, color gamut adjustment, color temperature adjustment, γ value adjustment (gamma value adjustment) and the like, are implemented sequentially as a calibration process.

In step S104, the calibration application 210 sends a request to display a colorimetry image (patch image) on the monitor 100, in order to carry out the colorimetry necessary for the (adjustment steps of) calibration. The display request data includes an indication of RGB values as colors which are to be displayed as a colorimetry image, for example. The colorimetry image is set for each adjustment step.

In step S105, after receiving the display completion notification of the colorimetry image from the monitor 100, the calibration application 210 measures the color of the colorimetry image displayed on the monitor 100, by controlling the colorimetric sensor 300 by the colorimeter control unit 213. In one adjustment step, it is possible to execute the display and measurement of the colorimetry image a plurality of times.

In step S106, after performing colorimetry by the colorimeter control unit 213, the calibration calculation unit 212 carries out a calibration calculation process so as to match the calibration target value input by the user in step S101. In the calibration calculation process, the set values of the image quality adjustment parameters are calculated.

In step S107, the calibration application 210 carries out the calibration calculation processing and then sends the calculation result (the calibration calculation data), to the monitor 100. The calibration calculation data includes set values for a plurality of image quality adjustment parameters, such as the backlight brightness, color temperature, color gamut, γ value, and so on.

In step S108, the calibration application 210 determines whether all of the calibration steps (adjustment steps) have been completed. When all of the calibration steps have been completed (YES at S108), then the processing advances to step S109.

In step S109, the calibration application 210 sends a calibration completion notification to the monitor 100.

When all of the calibration steps have not been completed (NO at S108), then the procedure returns to step S104, a colorimetry image display request for the next adjustment step is sent, and the processing is carried out.

Calibration control of the monitor 100 by the PC 200 is carried out on the basis of the flow described above.

Next, the operation of the calibration of the monitor 100 will be described.

Figure 5:
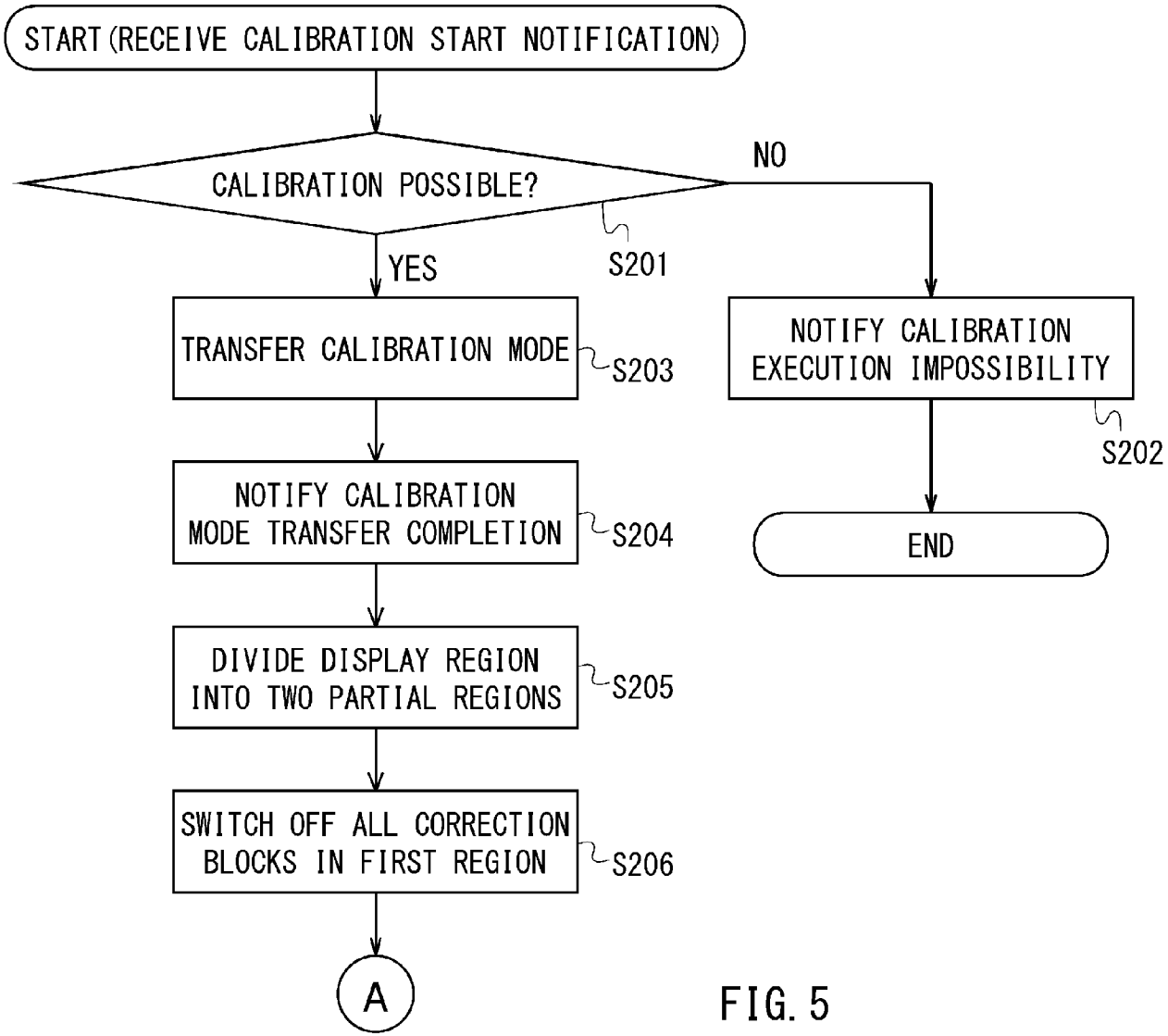
FIG. 5 is a diagram showing an example (1/2) of a calibration flow of the monitor relating to the first embodiment.
Figure 6:
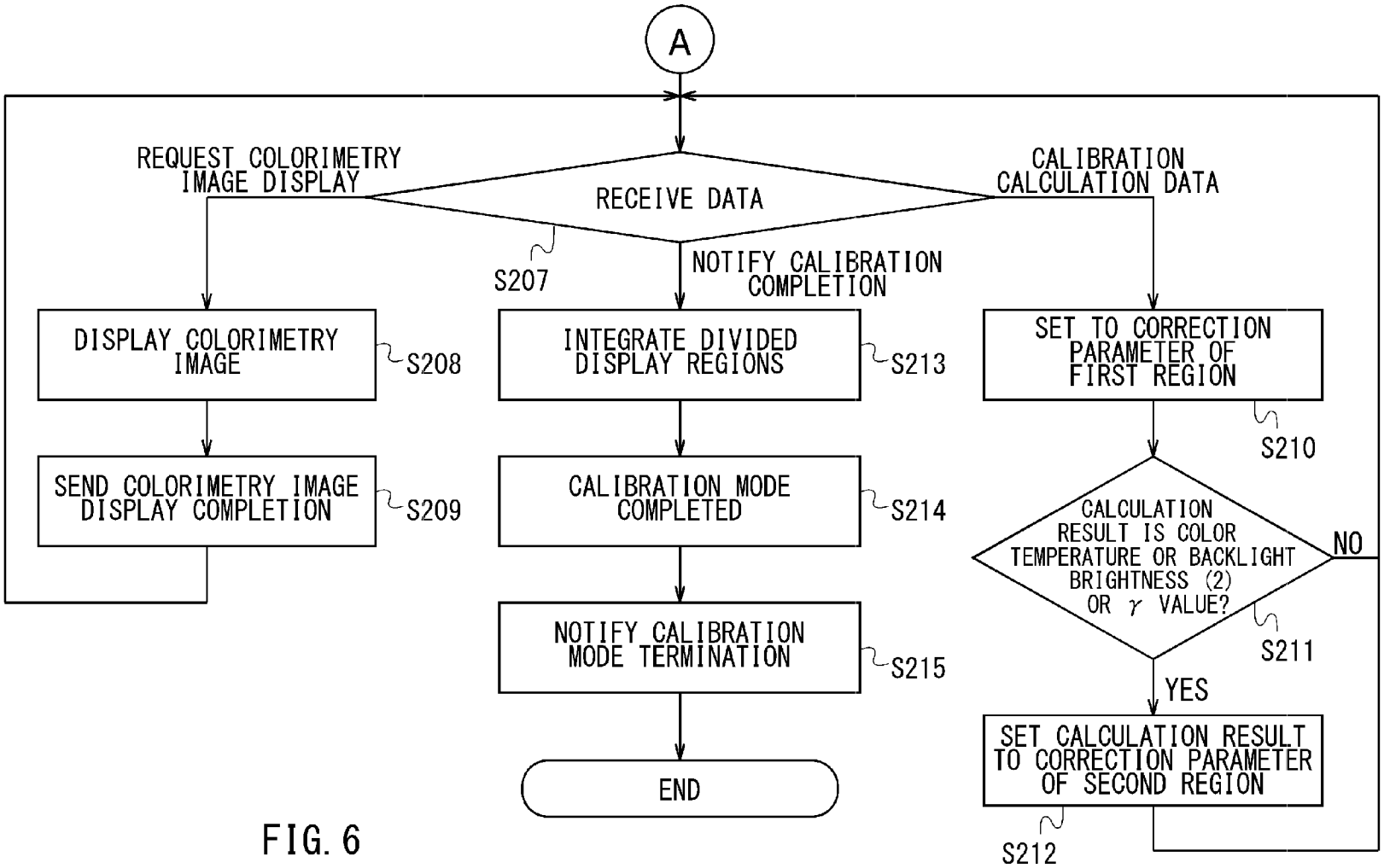
FIG. 6 is a diagram showing an example (2/2) of a calibration flow of the monitor relating to the first embodiment.

FIG. 5 and FIG. 6 are diagrams showing an example of a calibration flow of the monitor 100 relating to a first embodiment. "A" in FIG. 5 connects to "A" in FIG. 6.

The calibration control unit 110 of the monitor 100 starts the flow in FIG. 5 and FIG. 6 upon receiving a calibration start notification from the PC 200 via the communications control unit 108.

In step S201, the calibration control unit 110 determines whether or not calibration is possible, as the status of the monitor 100.

When the monitor 100 is in a state where calibration cannot be implemented (for example, when an error has occurred inside the monitor 100), (NO at S201), then the processing advances to step S202. On the other hand, when the monitor 100 is in a state where calibration can be implemented (YES at S201), then the processing advances to step S203.

In step S202, the calibration control unit 110 sends a notification that calibration cannot be implemented, to the PC 200, via the communications control unit 250, and processing then terminates.

In step S203, the calibration control unit 110 transfers the internal status of the monitor 100 to calibration mode.

In step S204, the calibration control unit 110 sends a calibration mode transfer completion notification to the PC 200 via the communications control unit 250.

In step S205, after transferring to the calibration mode, the calibration control unit 110 divides the display region of the screen of the display unit 103 into two partial regions, a first region and a second region, via the display control unit 102. The first region is a display region which displays a colorimetry image (color patch) for calibration. The second region is a display region for displaying (confirmation display) an image for confirmation in order to check the effects of the calibration. In the present embodiment, the PC image which is output from the PC 200 and is input from the image signal input unit 101 is displayed in the second region. The PC image is an image of an application, or the like, which is being run on the PC 100, other than the calibration application 210. Rather than a PC image, it is also possible to use an image stored in the monitor 100, as the confirmation image.

The first image processing unit 111 carries out image quality adjustment of the first region which displays the colorimetry image, and the second image processing unit 112 carries out image quality adjustment of the second region which displays the confirmation image. The first image processing unit 111 carries out image quality adjustment processing of the image displayed in the first region, as image processing. The second image processing unit 112 carries out image quality adjustment processing of the image displayed in the second region, as image processing. In the image quality adjustment processing, correction of the displayed image is carried out by using set values of the respective image quality adjustment parameters. The image quality adjustment parameters are the backlight brightness, the color temperature, the color gamut and the γ value. The image quality adjustment parameters are not limited to these parameters and other parameters may be employed. In the image quality adjustment processing, it is possible to switch the image quality adjustment processing on and off, for each respective image quality adjustment parameter. A state where the image quality adjustment process is switched off means a state where image quality adjustment process is not carried out, or a state where the set value of the image quality adjustment parameter is the initial value of the monitor 100, for example. The details relating to the on/off control of the image quality adjustment process are described below.

In step S206, the calibration control unit 110 switches off all of the image quality adjustment processing of the first image processing unit 111, for the purpose of calibration. In other words, the first region of the monitor 100 is a display in which all correction processing is eliminated temporarily, for the purpose of calibration. On the other hand, the second image processing unit 112 remains at this time in a state where all of the image quality adjustment processing is on. In other words, in the second region, the image from the PC 200 is displayed in a state of the same image quality settings (image quality adjustment) as before the start of calibration. Therefore, in the second region, it is possible to prevent the user from seeing an image in which the image quality adjustment processes are switched off.

In step S207, the calibration control unit 110 branches the processing in accordance with the data received from the PC 200 to the data received via the communication line 500. When the data received from the PC 200 is a display request for the colorimetry image, then the processing advances to step S208. When the data received from the PC 200 is calibration calculation data which is a calculation result, then the processing advances to step S210. When the data received from the PC 200 is a calibration completion notification, then the processing advances to step S213.

In step S208, the calibration control unit 110 displays a colorimetry image (color patch) having RGB values designated by the colorimetry image display request, via the display control unit 102, in the first region.

In step S209, when the display of the colorimetric image has been completed, the calibration control unit 110 sends a colorimetry image display completion notification to the PC 200 via the communications control unit 250. Moreover, the calibration control unit 110 returns to step S207 and enters again into a mode awaiting data reception from the PC 200.

Furthermore, in step S210, the calibration control unit 110 sets the image quality adjustment parameters, which are included in the received calibration calculation data, to the first region where the first image processing unit 111 is processed. Consequently, the set values of the image quality adjustment parameters (for example, the white brightness) before calibration of the first region are switched to the set values of the image quality adjustment parameters (for example, the color temperature) of the calibration calculation data received from the PC 200 (in other words, the parameters after calibration).

In step S211, the calibration control unit 110 branches the processing in accordance with the type of image quality adjustment parameter of the received calibration calculation data. When the calibration calculation data received from the PC 200 is other than the color temperature, the second backlight brightness or γ value (NO at S211), then the processing returns to step S207, and again enters a mode of awaiting data from the PC 200. On the other hand, when the calibration calculation data is the color temperature, the second backlight brightness or the γ value (YES at S211), then the set values of all of the image quality adjustment parameters received thus far are applied also to the second region which is processed by the second image processing unit 112. After applying the set values of the various image quality adjustment parameters to the second region which is processed by the second image processing unit 112, the processing returns to step S207 and again enters a mode awaiting the reception of data from the PC 200.

When the series of calibration (all of the adjustment steps) have been completed, the PC 200 notifies the monitor 100 that calibration has been completed. The monitor 100 then receives the calibration completion notification from the PC 200, via the communication line 500 and the communications control unit 108.

In step S213, the display region which is divided into two partial regions in step S205 is integrated into one region. The image processing after integration is carried out comprehensively by the first image processing unit 111 or the second image processing unit 112.

In step S214, the calibration control unit 110 integrates the display regions and then returns the internal status of the monitor 100, which was changed to calibration mode in step S203, to the original normal mode.

In step S215, when the change of the internal status has been completed, the calibration control unit 110 notifies the PC 200 of the completion of calibration mode, via the communications control unit 250.

By the control flows of the PC 200 and the monitor 100 described above, calibration is completed.

Next, the calibration steps carried out by the calibration calculation unit 203 and the contents of the on/off control of the respective image quality adjustment processes in the first image processing unit 111 and the second image processing unit 112 of the monitor 100 will be described with reference to FIGS. 7A and 7B.

FIG. 7A is a diagram showing an example of a flow of calibration which is controlled by the calibration application 210 of the PC 200. In the example in FIG. 7A, when calibration is started, processing is carried out in the following sequence of adjustment steps: first backlight brightness adjustment, color temperature adjustment, color gamut adjustment, second backlight brightness adjustment, and γ value adjustment; whereby the calibration is completed. The calibration application 210 reports information about the colorimetry image required for adjustment, together with the adjustment contents, to the monitor 100, and calculates set values for the various image quality adjustment parameters, by using the results of colorimetry of the colorimetry image (color patch) using the colorimetric sensor 300. Furthermore, the calibration application 210 sequentially carries out notification of the calculated set values of the image quality adjustment parameters, to the monitor 100, in the sequence of the flows described above.

FIG. 7B is a diagram showing the states of the various image quality adjustment parameters which are held by the first image processing unit 111 and the second image processing unit 112 of the monitor 100, and corresponds to the calibration flow in FIG. 7A. There are four image quality adjustment parameters which are held by the first image processing unit 111 and the second image processing unit 112: the backlight brightness, the color temperature, the color gamut and the γ value, in accordance with the calibration flow.

The example in FIG. 7B shows the states of the image quality adjustment parameters of the first image processing unit 111 and the second image processing unit 112, after the start of calibration, after the first backlight brightness adjustment, after the color temperature adjustment, after the color gamut adjustment, after the second backlight brightness adjustment, and after the γ value adjustment. For example, after starting calibration, the image quality adjustment processes for the backlight brightness, color temperature, color gamut and γ value in the first image processing unit 111 are off. Furthermore, after the start of calibration, the image quality adjustment processes for the backlight brightness, the color temperature, the color gamut and the γ value in the second image processing unit 112 are on, and the set values for the image quality adjustment parameters before calibration are applied in the second image processing unit 112.

Before the start of calibration (at the start of calibration), the display region is not divided into two partial regions, and the image is adjusted on the basis of the set values for the image quality adjustment parameters before calibration ("(ON)" in FIG. 7B).

The calibration control unit 110 receives notification of the start of calibration, from the PC 200, sets the internal status to calibration mode, and then divides the display region into two partial regions: a first region and a second region. Furthermore, the calibration control unit 110 also switches off all of the image quality adjustment processes of the first image processing unit 111 which handles the first region. A state where the image quality adjustment process is switched off means a state where the set values of the image quality adjustment parameters are the initial values of the monitor 100. On the other hand, the set values of the image quality adjustment parameters of the second image processing unit 112 which handles the second region remain the set values of the image quality adjustment parameters before calibration.

By implementing control of this kind, in the first region of the display unit 103, all of the image quality adjustment processing is switched off in order to carry out colorimetry for calibration. Furthermore, in the second region, a display which maintains the display state used hitherto (before the start of calibration) is instructed, rather than showing the user an image in which no correction processing has been carried out.

When the first backlight brightness is calculated by the processing of the calibration application 210, the calibration control unit 110 of the monitor 100 which has received this information applies the first backlight brightness as the backlight brightness of the first image processing unit 111. In other words, for the backlight brightness of the first region, the set value of the post-calibration image quality adjustment parameter ("ON" in FIG. 7B) is employed. Furthermore, the image adjustment processing other than the backlight brightness is switched off in the first region. In this case, in the second region, the set values of the image quality adjustment parameters before calibration are applied as the set values of all of the image quality adjustment parameters.

Subsequently, when the color temperature is calculated by the processing of the calibration application 210, the calibration control unit 110 of the monitor 100 which has received this information applies the calculated color temperature as the color temperature in the first image processing unit 111. Since the received calibration result is the color temperature, then the calibration control unit 110 also reflects the calibration results thus far, in the second region. Therefore, the calibration control unit 110 copies the data applied thus far as the backlight brightness and the color temperature of the first image processing unit 111 and applies these respectively as the backlight brightness and the color temperature of the second image processing unit 112. In this case, in the second region, the backlight brightness and the color temperature after calibration are applied respectively as the backlight brightness and the color temperature, and the color gamut and the γ value before calibration are applied respectively as the color gamut and the γ value. By adopting a configuration of this kind, the user is able to check how the appearance of the image has changed, at an intermediate stage of the calibration, in the second region.

Subsequently, when the color gamut is calculated by the processing of the calibration application 210, the calibration control unit 110 of the monitor 100 which has received this information applies the calculated color gamut as the color gamut of the first image processing unit 111. Since the received calibration result is the color gamut, the calibration control unit 110 does not reflect the calibration result in the second region and waits for the reception of the next calibration result. In this case, in the second region, of course, the backlight brightness and the color temperature after calibration are applied respectively as the backlight brightness and the color temperature, and the color gamut and the γ value before calibration are applied respectively as the color gamut and the γ value.

Next, when the second backlight brightness is calculated by the processing of the calibration application 210, the calibration control unit 110 of the monitor 100 which has received this information applies the second backlight brightness as the backlight brightness of the first image processing unit 111. Since the received calibration result is the second backlight brightness, then the calibration control unit 110 also reflects the calibration results thus far, in the second region. In other words, the calibration control unit 110 copies the data applied as the backlight brightness and the color gamut of the first image processing unit 111 and applies these respectively as the backlight brightness and the color gamut of the second image processing unit 112. In this case, in the second region, the backlight brightness, the color temperature and the color gamut after calibration are applied respectively as the backlight brightness, the color temperature and the color gamut, and the γ value before calibration is applied as the γ value.

Moreover, when the γ value is calculated by the processing of the calibration application 210, the calibration control unit 110 of the monitor 100 which has received the γ value applies the calculated γ value as the γ value of the first image processing unit 111. Since the received calibration result is the γ value, than the calibration control unit 110 also reflects the calibration results thus far, in the second region. Therefore, the calibration control unit 110 copies the data applied as the γ value of the first image processing unit 111, and applies this data as the γ value of the second image processing unit 112. In this case, in the second region, the set values of the image adjustment parameters after calibration are employed for the set values of all of the image quality adjustment parameters. Consequently, the user is able to check the final results of calibration in the second region.

By adopting the present embodiment, the display region of the display unit 103 is divided into a first region for colorimetry and a second region which displays a PC image, or the like, and the set values of the image quality adjustment parameters which are the result of calibration are applied in stepwise fashion in the second region. According to the present embodiment, image quality adjustment is carried out independently of the first region and the second region of the display unit 103. According to the present embodiment, the image quality adjustment processing is not switched off in the second region. Consequently, the user is able to perceive a state where an image progressively changes due to calibration in the second region, and the user can obtain a sense of agreement with the calibration that has been made.

In the present embodiment, control is adopted by which the monitor 100 displays a colorimetry image on the basis of an instruction from the PC 200, but control may also be implemented in such a manner that the PC 200 displays a colorimetry image and an image designated by the user, and notifies the respective display positions thereof to the monitor 100.

Furthermore, in the present embodiment, control is implemented whereby the calculated image quality adjustment parameters are reflected in the second region, at the stage that any one of the color temperature adjustment, the second backlight brightness adjustment and the γ value adjustment has been completed. However, the invention is not limited to this, and it is also possible to reflect these parameters in the second region at different timings, or to reflect all of the set values of the image quality adjustment parameters in the second region at every moment of value reception.

Furthermore, in the present embodiment, a configuration is adopted in which the calibration calculations and colorimetric sensor control are realized by the PC 200, but it is also possible to adopt a configuration in which these controls are carried out by the monitor 100.

According to the present embodiment, the user can recognize the progressive step-by-step improvement of the image quality of the desired image displayed on the second region on account of the calibration, and can confirm the results due to calibration. Therefore, the user is able to gain a sense of agreement with the calibration that has been made, which is not possible in the prior art, and hence the usability for the user is improved.

Second Embodiment

The second embodiment has a feature of differing from the first embodiment in terms of the timing at which the image desired by the user can be checked. In the second embodiment, the user is able to select whether or not a confirmation image desired by the user is displayed synchronously in line with the progress of calibration. The following description principally concerns the portions which are different to the first embodiment, and the configuration which is similar to the first embodiment is omitted from the description.

Figure 8:
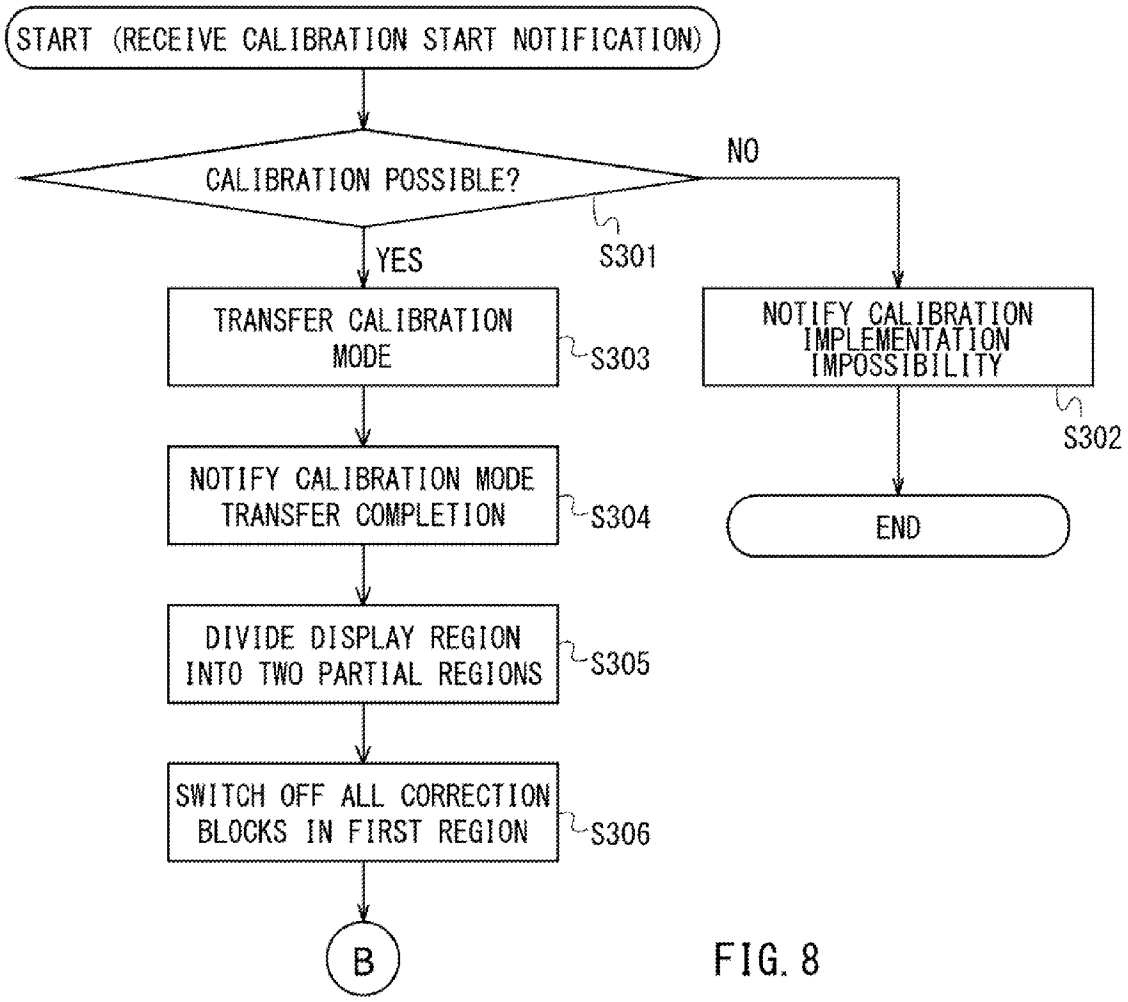
FIG. 8 is a diagram showing an example (1/3) of a calibration flow of the monitor relating to a second embodiment.
Figure 9:
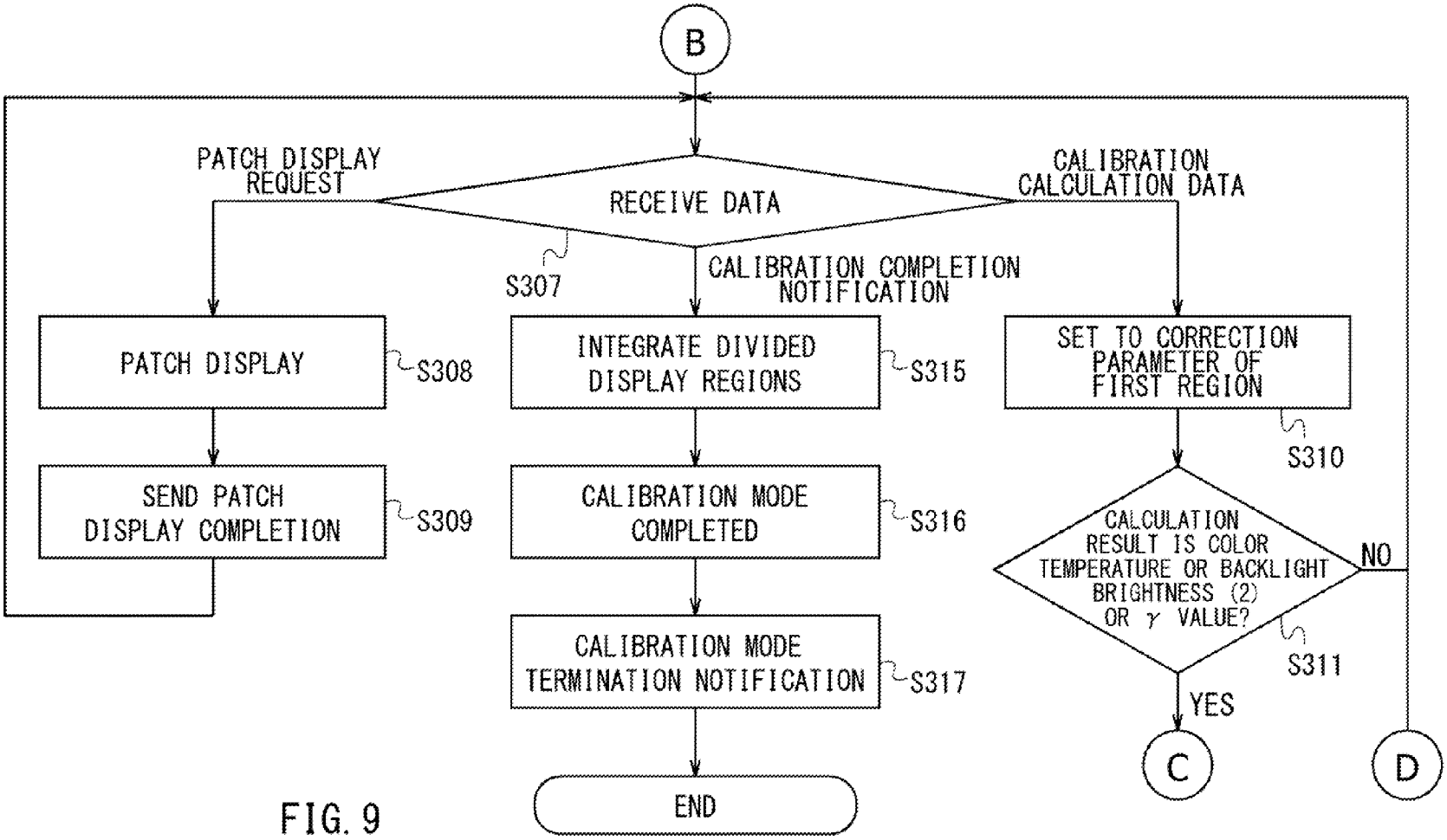
FIG. 9 is a diagram showing an example (2/3) of a calibration flow of the monitor relating to the second embodiment.
Figure 10:
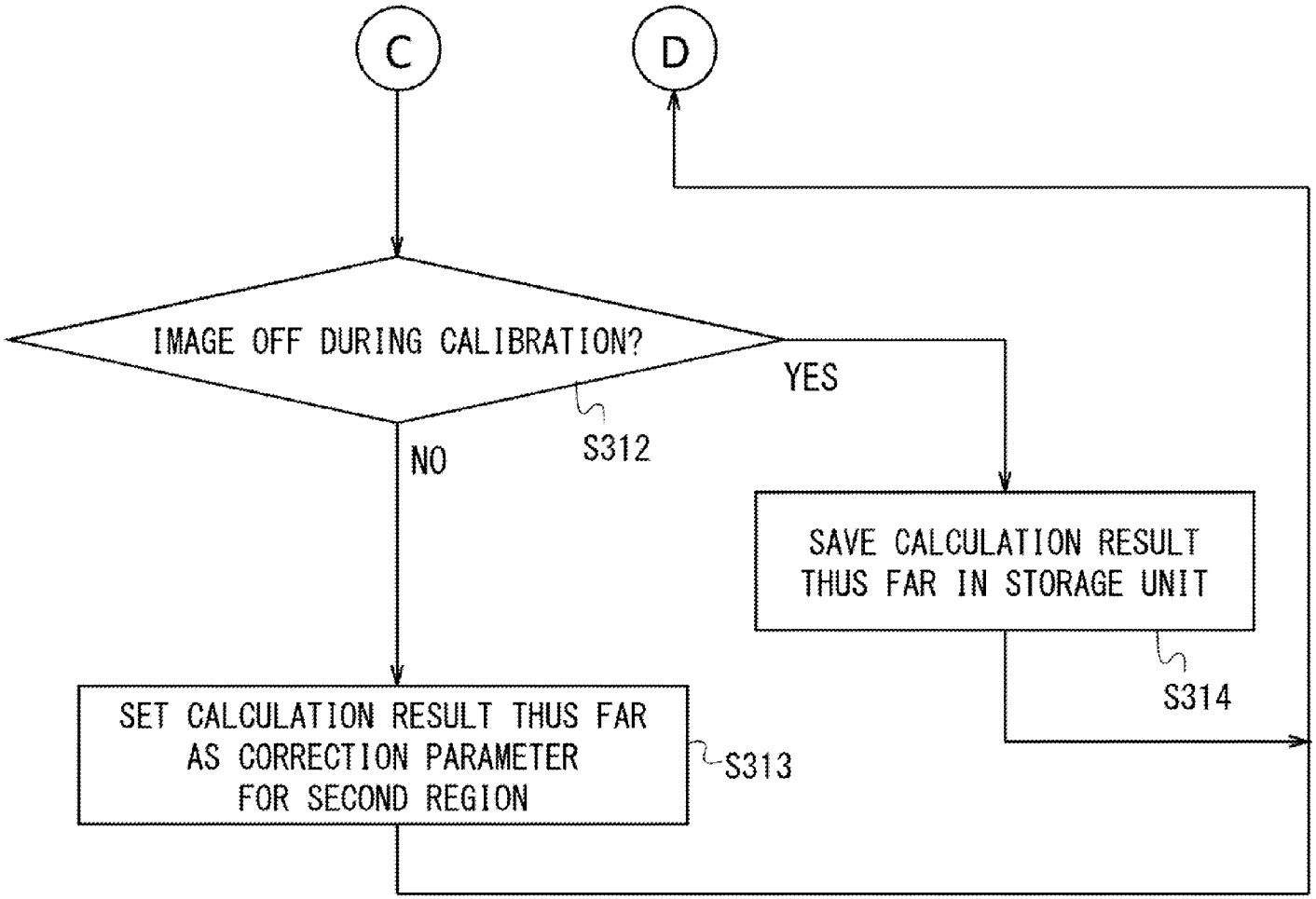
FIG. 10 is a diagram showing an example (3/3) of a calibration flow of the monitor relating to the second embodiment.

FIG. 8, FIG. 9 and FIG. 10 are flowcharts for describing the calibration flow of the monitor 100 which is controlled by the calibration control unit 110 according to the present embodiment. "B" in FIG. 8 connects to "B" in FIG. 9. "C" and "D" in FIG. 9 respectively connect to "C" and "F" in FIG. 10.

The calibration control unit 110 of the monitor 100 starts the flow in FIG. 8, FIG. 9 and FIG. 10 upon receiving a calibration start notification from the PC 200 via the communications control unit 108.

The monitor 100 receives information indicating whether or not to display the image for confirming the effect of calibration in synchronism with the progress of the calibration steps, during calibration, as well as the calibration start notification. When, for example, the user wishes to confirm the state of change while displaying a desired image during the calibration steps, then an instruction to switch on the display during the calibration steps is issued while starting calibration by the calibration application 210 of the PC 200. On the other hand, if the user does not wish to confirm the change in the image in accordance with the calibration steps, because, for example, the user wishes to carry out another task, during the calibration steps, then an instruction to switch off the display during the calibration steps is issued.

The calibration control unit 110 which has received information about the on/off switching of display during the calibration steps temporarily saves this information in a storage unit 106 during calibration.

In step S301, the calibration control unit 110 determines whether or not calibration is possible, as the status of the monitor 100. Thereafter, the processing from step S302 to step S311 is similar to the processing from step S201 to step S211 of the first embodiment.

In step S311, when the received calibration calculation data is the color temperature, the second backlight brightness or the γ value (YES at S311), then the processing advances to step S312.

In step S312, the calibration control unit 110 reads out the received information about the on/off switching of the display during the calibration steps, together with the calibration start notification, from the storage unit 106. The calibration control unit 110 determines whether or not the information thus read out indicates switching off of the display during the calibration steps. If the information read out indicates switching on of the display during the calibration steps (NO in S312), then the processing advances to step S313. The processing in step S313 is similar to the processing in step S212 of the first embodiment. On the other hand, if the information read out indicates switching off of the display during the calibration steps (YES at S312), then the processing advances to step S314.

In step S314, the calibration control unit 110 saves the calculation result (the result of the calibration calculation) received thus far from the PC 100, to the storage unit 106. In this case, the calibration control unit 110 saves the data received from the PC 100, in the storage unit 106, each time the processing in step S314 is carried out, so that the progress of change in the appearance of the image as a result of the calibration can be seen later in a stepwise fashion. For example, the calibration control unit 110 saves the data up to and including the color temperature adjustment including the first backlight brightness adjustment, as intermediate data 1, saves the data up to and including the second backlight brightness adjustment including the color gamut, as intermediate data 2, and saves the data up to and including the γ value adjustment, as the final data. Thereupon, returning to S307, the procedure again enters a mode of awaiting reception of data from the PC 200. Consequently, here, the image quality adjustment parameter of the second image processing unit 112 which handles the second region is not changed. In other words, the image quality adjustment parameters of the second image processing unit 112 are the same set values of the image quality adjustment parameters before calibration.

The processing from step S315 to step S317 is similar to the processing from step S213 to step S215 of the first embodiment.

Furthermore, by the user switching off the display during the calibration steps, after completing the calibration processing, it is possible for the user to check the effects of calibration while displaying a particular image on the monitor 100. In this case, the monitor 100 receives an image desired by the user, from the image signal input unit 101, and displays the image on the display unit 103. Moreover, the calibration control unit 110 of the monitor 100 applies the intermediate data 1, the intermediate data 2 and the final data which have been saved in the storage unit 106, sequentially, as the image quality adjustment parameters, and displays the image in question on the display unit 103. Consequently, the monitor 100 is able to indicate the effects due to calibration. After completing calibration, the user is able to confirm the effects due to calibration.

According to the second embodiment, the monitor 100 can display an image by applying the image adjustment parameters before calibration in the second region, while displaying the colorimetry image for calibration in the first region. In other words, while calibration is being implemented, the image quality settings of the second region are left as the image quality settings before calibration. Therefore, it is possible to progress with other tasks irrespective of the calibration processing, during the calibration steps. Furthermore, since the set values of the image quality adjustment parameters are saved in a stepwise fashion during calibration, the monitor 100 can enable the user to confirm the effects of calibration after the completion of calibration.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-Ray Disc (BD)™), a flash memory device, a memory card, and the like.

The respective embodiments described above can be implemented in combination with each other, as far as possible.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-34234, filed on Feb. 25, 2014, which is hereby incorporated by reference herein in its entirety.

What is claimed is:

1. A calibration device for a display device, the calibration device comprising:

a processor; and a memory coupled to the processor to store instructions that cause the processor to execute:

receiving a confirmation image selected by a user;

controlling the display device to display a colorimetry image on a first display region of the display device and the confirmation image on a second display region of the display device; and performing calibration to update set values of a plurality of image quality adjustment items based on colorimetry results from the colorimetry image; and selecting whether or not to carry out synchronous display mode for displaying the confirmation image in synchronism with progress of the calibration; wherein in a case that the synchronous display mode has been selected, the display device is controlled so as to display the confirmation image in the second display region using a plurality of set values, which are set before the calibration, at the start of the calibration, and update the plurality of set values of the second display region in synchronism with progress of the calibration during the calibration; and in a case that the synchronous display mode has not been selected, the display device is controlled not to update the confirmation image with the plurality of set values during the calibration.

2. The calibration device according to claim 1, further comprising:

a storage unit configured to store the set values of the plurality of image quality adjustment items, wherein in the synchronous display mode:

the display device is controlled so as to display the confirmation image on a basis of at least three image quality settings, which are a first image quality setting before the calibration, a second image quality setting during the calibration and a third image quality setting after the calibration;

the first image quality setting is a setting in which all of the set values of the plurality of image quality adjustment items are the same as the values set in the storage unit before the calibration;

the second image quality setting is a setting in which one portion of the set values of the plurality of image quality adjustment items is the same as the values set in the storage unit before the calibration, and the rest is updated by the calibration; and the third image quality setting is a setting in which all of the set values of the plurality of image quality adjustment items are updated by the calibration.

3. The calibration device according to claim 2, wherein in the case that the synchronous display mode has not been selected, the first, second and third image quality settings are stored in the storage unit, so that the effects of the calibration can be confirmed on the display device after the completion of the calibration.

4. The calibration device according to claim 1, wherein the plurality of image quality adjustment items include at least one of brightness adjustment of a light-emitting unit, color temperature adjustment, color gamut adjustment and gamma value adjustment of the display device.

5. The calibration device according to claim 1, wherein the processor configured to update the set values by each of a plurality of adjustment steps based on the colorimetry results acquired by each of the plurality of adjustment steps.

6. The calibration device according to claim 5, wherein the plurality of adjustment steps is corresponding to the plurality of image quality adjustment items.

7. The calibration device according to claim 1, wherein the display device is controlled so as to display the confirmation image which is subjected to image quality adjustment processing using the updated set values updated by the calibration.

8. A display device, which is provided with the calibration device according to claim 1.

9. A calibration method for a display device, the method comprising:

receiving a confirmation image selected by a user;

controlling the display device to display a colorimetry image on a first display region of the display device and the confirmation image on a second display region of the display device;

performing calibration to update set values of a plurality of image quality adjustment items based on colorimetry results from the colorimetry image, selecting whether or not to carry out synchronous display mode for displaying the confirmation image in synchronism with progress of the calibration; and controlling the display device in accordance with whether or not the synchronous mode is selected; wherein in a case that the synchronous display mode has been selected, the display device is controlled so as to display the confirmation image in the second display region using a plurality of set values, which are set before the calibration, at the start of the calibration, and update the plurality of set values of the second display region in synchronism with progress of the calibration during the calibration; and in a case that the synchronous display mode has not been selected, the display device is controlled not to update the confirmation image with the plurality of set values during the calibration.

10. The calibration method according to claim 9, wherein a storage unit is provided for storing the set values of the plurality of image quality adjustment items, and wherein in the synchronous display mode:

the display device is controlled so as to display the confirmation image on a basis of at least three image quality settings, which are a first image quality setting before the calibration, a second image quality setting during the calibration and a third image quality setting after the calibration;

the first image quality setting is a setting in which all of the set values of the plurality of image quality adjustment items are the same as the values set in the storage unit before the calibration;

the second image quality setting is a setting in which one portion of the set values of the plurality of image quality adjustment items is the same as the values set in the storage unit before the calibration, and the rest is updated by the calibration; and the third image quality setting is a setting in which all of the set values of the plurality of image quality adjustment items are updated by the calibration.

11. The calibration method according to claim 10, wherein in the case that the synchronous display mode has not been selected, the first, second and third image quality settings are stored in the storage unit, so that the effects of the calibration can be confirmed after the completion of the calibration.

12. The calibration method according to claim 9, wherein the plurality of image quality adjustment items include at least one of brightness adjustment of a light-emitting unit, color temperature adjustment, color gamut adjustment and gamma value adjustment of the display device.

13. The calibration method according to claim 9, wherein the set values are updated by each of a plurality of adjustment steps based on the colorimetry results acquired by each of the plurality of adjustment steps.

14. The calibration method according to claim 13, wherein the plurality of adjustment steps is corresponding to the plurality of image quality adjustment items.

15. The calibration method according to claim 9, wherein the display device is controlled so as to display the confirmation image which is subjected to image quality adjustment processing using the updated set values updated by the calibration.

16. A calibration device for a display device, the calibration device comprising:

a processor; and a memory coupled to the processor to store instructions that cause the processor to execute:

receiving a confirmation image selected by a user;

controlling the display device to display a colorimetry image on a first region of the display device and the confirmation image on a second region of the display device, the confirmation image being different from the colorimetry image, and performing calibration comprising a plurality of steps for acquiring a plurality of set values corresponding to a plurality of adjustment items, respectively, based on colorimetry results obtained from the colorimetry image; wherein during the calibration, the display device is controlled so as to display the colorimetry image on the first region using a first group of set values and display the confirmation image on the second region using a second group of set values, the second group of set values including at least one different set value from the first group of set values, the second group of set values is updated using an acquired set value for each of the steps of the calibration such that a set value of the second group of set values, which corresponds to an adjustment item for the acquired set value, is updated using the acquired set value.

17. The calibration device according to claim 16, wherein each of the steps of the calibration updates at least one set value of the plurality of set values.

18. The calibration device according to claim 16, wherein the first group of set values is composed of a plurality of set values corresponding to the plurality of adjustment items, respectively, and the second group of set values is composed of a plurality of set values corresponding to the plurality of adjustment items, respectively.

19. The calibration device according to claim 16, further comprising a storage medium configured to store the plurality of set values corresponding to the plurality of adjustment items, wherein the storage medium stores an initial group of set values that is composed of a plurality of set values which are used for displaying an image on the display device before performing the calibration, and wherein the initial group of set values is set as the second group of set values at start of the calibration, and the second group of set values is updated with progress of each of the steps of the calibration.

20. The calibration device according to claim 16, wherein the plurality of adjustment items include brightness of a backlight, color temperature, color gamut, and gamma correction.

21. A calibration method for a display device, the method comprising:

receiving a confirmation image selected by a user;

controlling the display device to display a colorimetry image on a first region of the display device and the confirmation image on a second region of the display device, the confirmation image being different from the colorimetry image, and performing calibration comprising a plurality of steps for acquiring a plurality of set values corresponding to a plurality of adjustment items, respectively, based on colorimetry results obtained from the colorimetry image; wherein during the calibration, the display device is controlled so as to display the colorimetry image on the first region using a first group of set values and display the confirmation image on the second region using a second group of set values, the second group of set values including at least one different set value from the first group of set values, the second group of set values is updated using an acquired set value for each of the steps of the calibration such that a set value of the second group of set values, which corresponds to an adjustment item for the acquired set value, is updated using the acquired set value.

22. The calibration method according to claim 21, wherein each of the steps of the calibration updates at least one set value of the plurality of set values.

23. The calibration method according to claim 21, wherein the first group of set values is composed of a plurality of set values corresponding to the plurality of adjustment items, respectively, and the second group of set values is composed of a plurality of set values corresponding to the plurality of adjustment items, respectively.

24. The calibration method according to claim 21, wherein a storage medium is provided for storing the plurality of set values corresponding to the plurality of adjustment items, and wherein the storage medium stores an initial group of set values that is composed of a plurality of set values which are used for displaying an image on the display device before performing the calibration, and wherein the initial group of set values is set as the second group of set values at start of the calibration, and the second group of set values is updated with progress of each of the steps of the calibration.

25. The calibration method according to claim 21, wherein the plurality of adjustment items include brightness of a backlight, color temperature, color gamut, and gamma correction.

* * * * *